US007699663B1

(12) United States Patent
Little et al.

(10) Patent No.: US 7,699,663 B1
(45) Date of Patent: Apr. 20, 2010

(54) ELECTRICAL CONNECTOR WITH IMPROVED GROUNDING CONTACT

(75) Inventors: Terrance F. Little, York, PA (US); Kuan-Yu Chen, Harrisburg, PA (US); Stephen Sedlo, Valley Center, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/462,166

(22) Filed: Jul. 29, 2009

(51) Int. Cl.
*H01R 24/00* (2006.01)

(52) U.S. Cl. ..... 439/660

(58) Field of Classification Search ..... 439/660, 439/607.2, 607.21, 607.4, 607.31, 924.1
See application file for complete search history.

(56) References Cited

U.S. PATENT DOCUMENTS 5,685,739 A * 11/1997 Davis et al. ..... 439/607.38
5,769,666 A 6/1998 Wu
5,975,957 A 11/1999 Noda et al.
6,485,338 B1 * 11/2002 Wu ..... 439/862
6,500,026 B2 * 12/2002 Yamaguchi ..... 439/577
6,558,045 B2 * 5/2003 Yamaguchi ..... 385/75
6,638,121 B1 * 10/2003 Walker et al. ..... 439/885
6,688,779 B2 * 2/2004 Nishita ..... 385/75
6,835,092 B2 * 12/2004 Wan et al. ..... 439/541.5
6,881,096 B2 * 4/2005 Brown et al. ..... 439/620.01
6,957,982 B1 * 10/2005 Hyland et al. ..... 439/620.05
7,018,242 B2 * 3/2006 Brown et al. ..... 439/676
7,083,468 B2 * 8/2006 Walker et al. ..... 439/541.5
7,241,181 B2 * 7/2007 Machado et al. ..... 439/676
7,367,851 B2 * 5/2008 Machado et al. ..... 439/676
7,467,977 B1 * 12/2008 Yi et al. ..... 439/607.01
7,559,805 B1 * 7/2009 Yi et al. ..... 439/660
7,578,705 B2 * 8/2009 He et al. ..... 439/660
2002/0004336 A1 * 1/2002 Yamaguchi ..... 439/577
2002/0160656 A1 * 10/2002 Nishita ..... 439/577
2003/0194908 A1 * 10/2003 Brown et al. ..... 439/620
2004/0224558 A1 * 11/2004 Wan et al. ..... 439/541.5
2005/0181643 A1 * 8/2005 Brower et al. ..... 439/76.1
2005/0255745 A1 * 11/2005 Walker et al. ..... 439/541.5
2006/0009061 A1 * 1/2006 Machado et al. ..... 439/215
2008/0009194 A1 * 1/2008 Biddle et al. ..... 439/620.21
2008/0032546 A1 * 2/2008 Xuan et al. ..... 439/490
2008/0261448 A1 * 10/2008 Yi et al. ..... 439/607
2008/0311801 A1 * 12/2008 Chen et al. ..... 439/733.1
2009/0042450 A1 * 2/2009 Zheng et al. ..... 439/660
2009/0042451 A1 * 2/2009 He et al. ..... 439/660
2009/0130906 A1 * 5/2009 Tsao et al. ..... 439/626
2009/0149045 A1 * 6/2009 Chen et al. ..... 439/92

* cited by examiner

*Primary Examiner*—T C Patel
*Assistant Examiner*—Vladimir Imas
(74) *Attorney, Agent, or Firm*—Wei Te Chung; Andrew C. Cheng; Ming Chieh Chang

(57) ABSTRACT

An electrical connector includes a housing member and a number of contacts attached to the housing member. The contacts include a number of first contacts and second contacts arranged side by side along a transverse direction, respectively. The second contacts include a first pair of differential contacts, a second pair of differential contacts and a grounding contact disposed therebetween, the first contacts and the first and the second pairs of differential contacts are used for being soldered to the PCB while the grounding contact needn't be soldered to the PCB. The grounding contact includes a grounding tab to attach to the metal shell for grounding purpose. As a result, a much integral space between the first and the second contacts can be provided for receiving a fiber optical lens module.

20 Claims, 9 Drawing Sheets

ELECTRICAL CONNECTOR WITH IMPROVED GROUNDING CONTACT

BACKGROUND OF THE INVENTION

1. Field of the Invention

The present invention relates to electrical connectors, more particularly to electrical connectors with improved grounding contact in order to provide reasonable space for easily receiving a fiber optical lens module.

2. Description of Related Art

U.S. Pat. No. 5,769,666 discloses an electrical connector including an insulative housing, a plurality of contacts retained in the housing and a metal shield received in the housing. The contacts include contact portions and bending portions extending downwardly from rear ends of the contact portions. The bending portions are perpendicular to the contact portions and include contractive tail portions for being soldered to a PCB. The metal shield encloses the contact portions for EMI protection. The bending portions are arranged side by side at a rear wall of the housing. The bending portions occupy much area of the rear wall of the housing as a result that the rear wall of the housing doesn't have reasonable area for mounting additional components from a rear-to-front direction.

Hence, an improved electrical connector is desired to overcome the above problems.

BRIEF SUMMARY OF THE INVENTION

An electrical connector for being mounted on a PCB includes a housing member, a plurality of contacts attached to the housing member and a metal shell enclosing the housing member. The contacts include a plurality of first contacts having deformable first contact portions and a plurality of second contacts having stiff second contact portions under a condition that the first and the second contact portions are located at a same side of the housing member. The first and the second contact portions are respectively arranged side by side along parallel transverse directions. The first and the second contact portions offset from each other along a longitudinal direction perpendicular to the transverse directions. The second contacts include a first pair of differential contacts, a second pair of differential contacts and a grounding contact disposed therebetween. The first contacts and the first and the second pairs of differential contacts are used for being soldered to the PCB while the grounding contact needn't be soldered to the PCB. The grounding contact comprises a grounding tab opposite to the corresponding second contact portion to attach to the metal shell for grounding purpose. As a result, a relative wider and integral space can be provided between the first and the second contacts for easily mounting a fiber optical lens module.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
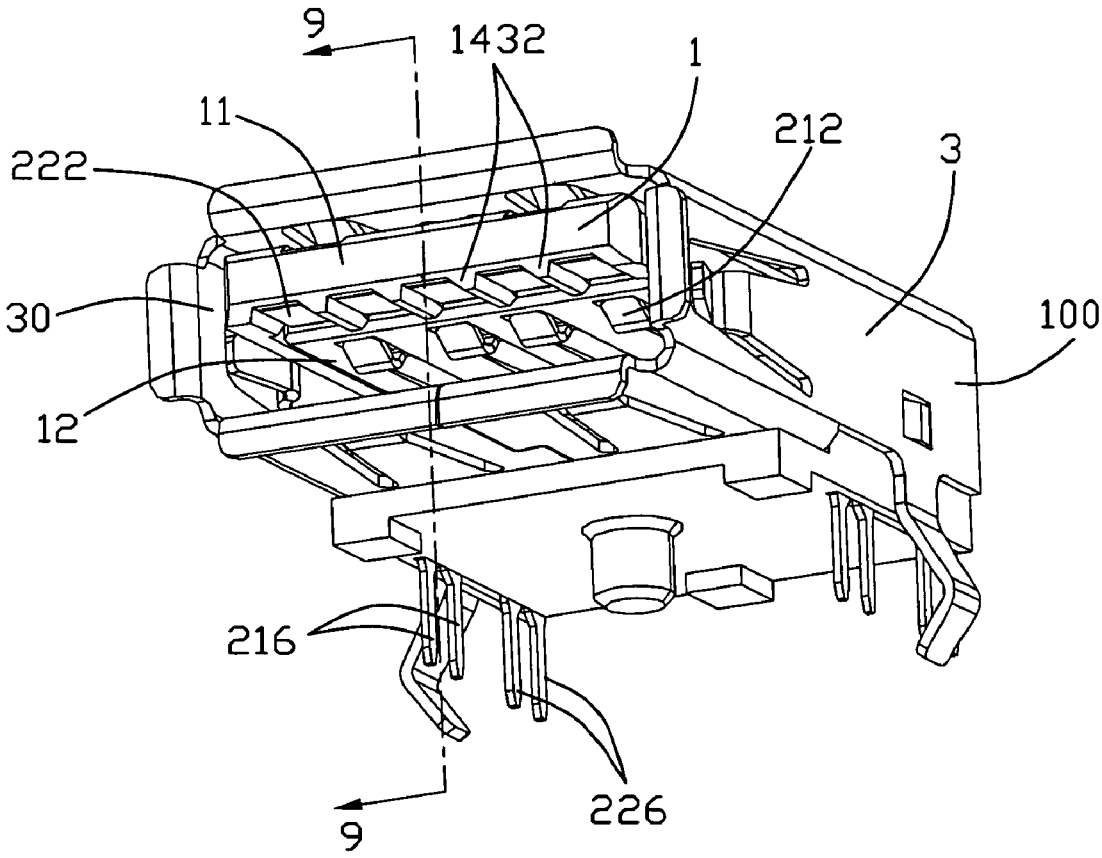
FIG. 1 is a perspective view of an electrical connector according to a preferred embodiment of the present invention with insertion of a fiber optical lens module thereinto.
Figure 2:
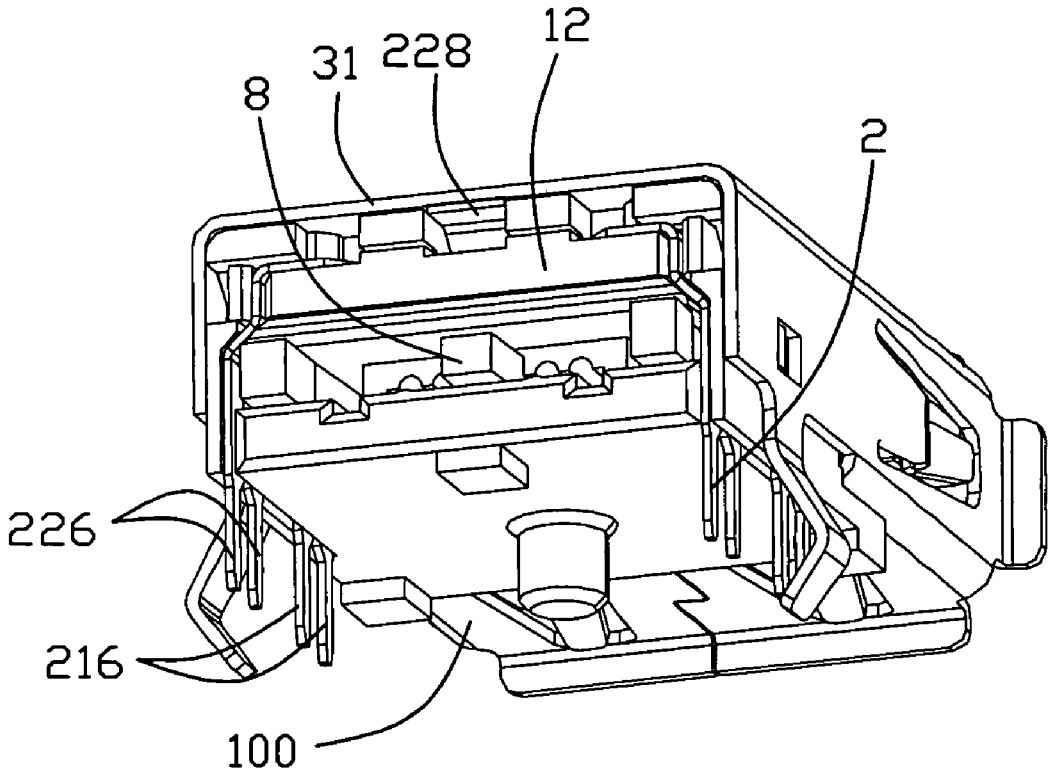
FIG. 2 is a perspective view of the electrical connector mounted with the fiber optical lens module shown in FIG. 1, while taken from another aspect.
Figure 3:
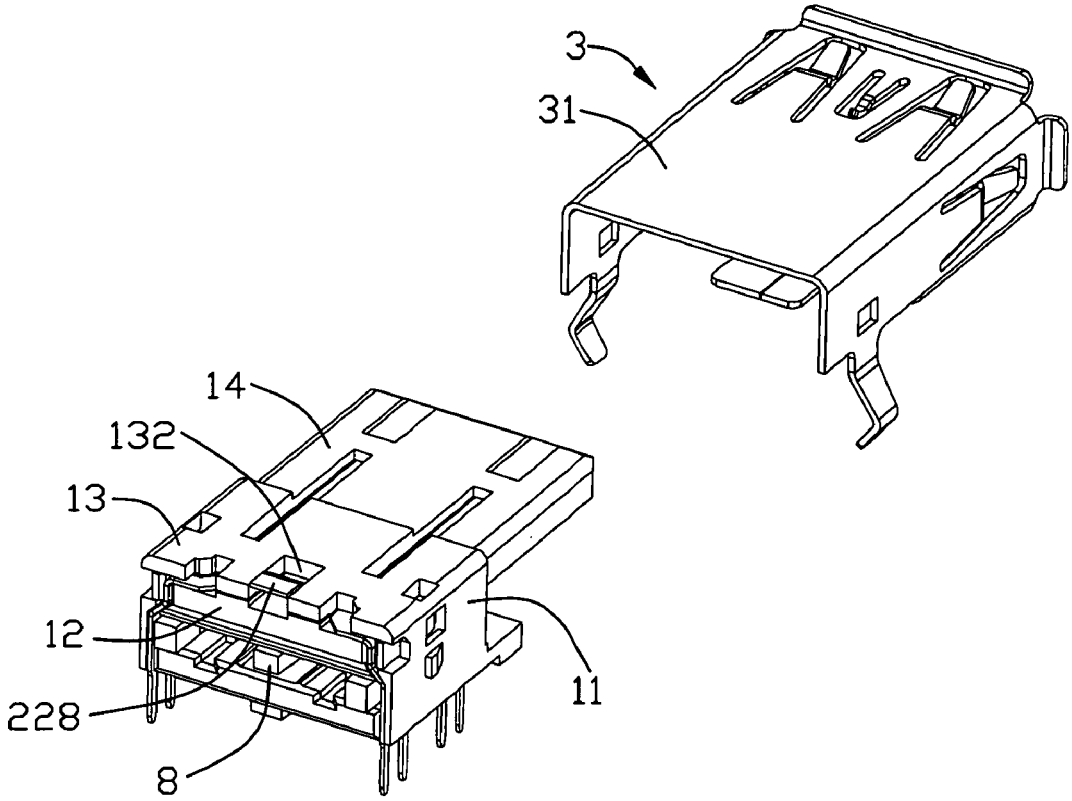
FIG. 3 is a part exploded view of the electrical connector mounted with the fiber optical lens module shown in FIG. 2, while with the metal shell apart therefrom.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-5, an electrical connector 100 defines a mating end for receiving a complementary connector (not shown) and a mounting end for being mounted on a printed circuit board (PCB, not shown). According to the preferred embodiment of the present invention, the electrical connector 100 is an optical/electrical connector and includes a housing member 1, a plurality of contacts 2 attached to the housing member 1 and a metal shield 3 enclosing the housing member 1. The housing member 1 includes a first insulative housing 11 and a second insulative housing 12 received in the first insulative housing 11. The separate first and second insulative housings 11, 12 can facilitate assembly of the contacts 2, which will be detailed hereinafter.

Figure 5:
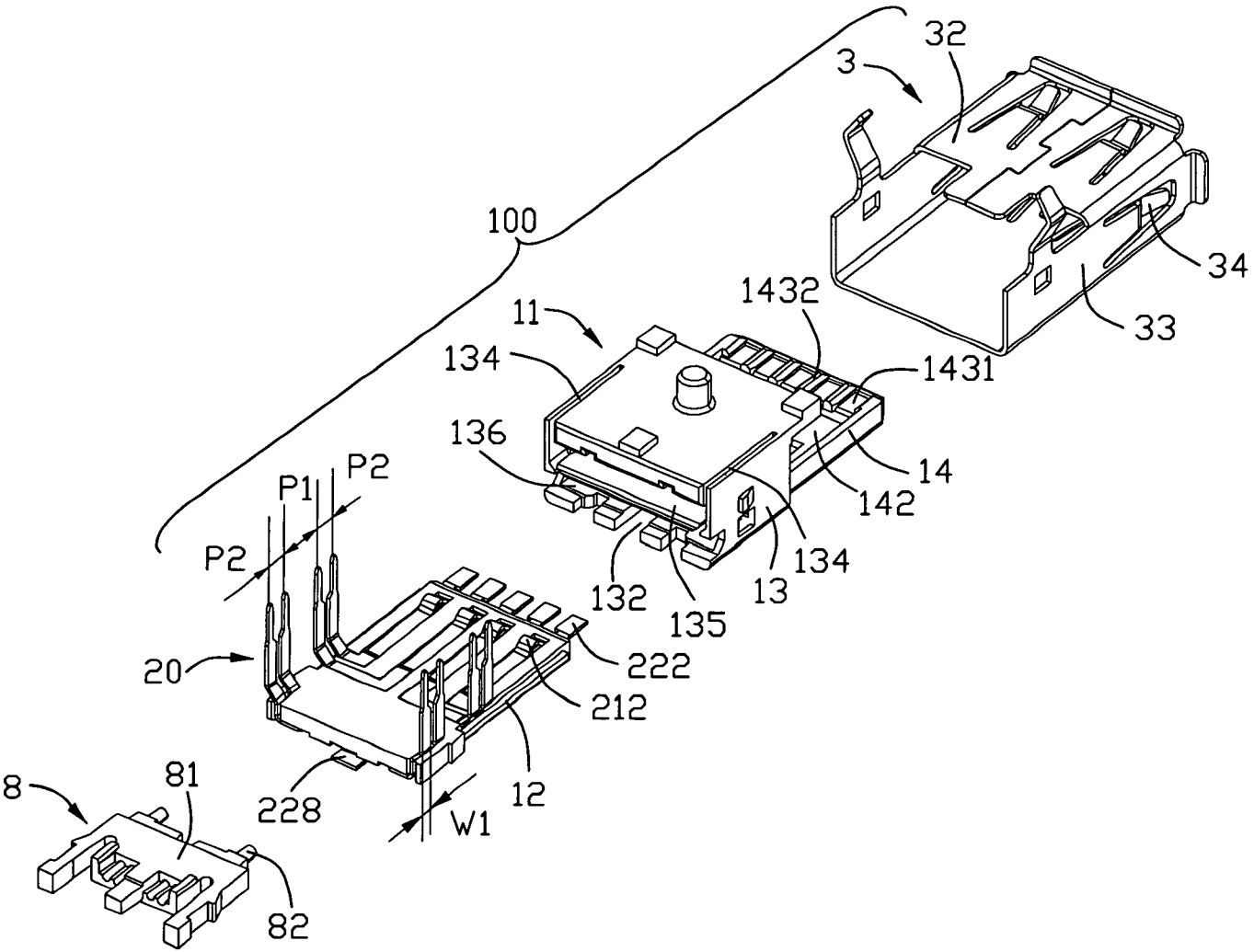
FIG. 5 is another part exploded perspective view of the electrical connector and the fiber optical lens module similar to FIG. 4, while taken from another aspect.
Figure 6:
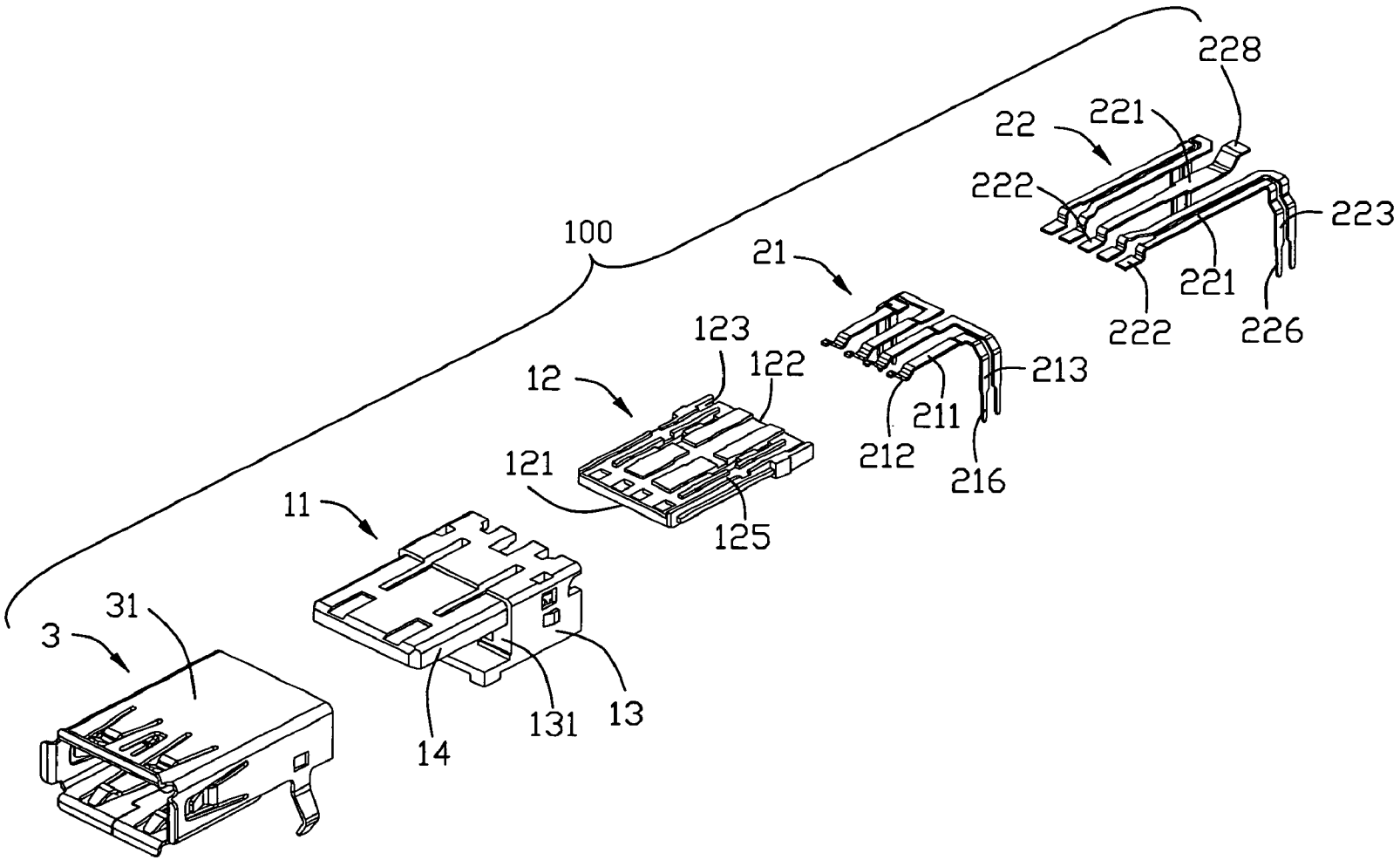
FIG. 6 is an exploded perspective view of the electrical connector shown in FIG. 1.
Figure 7:
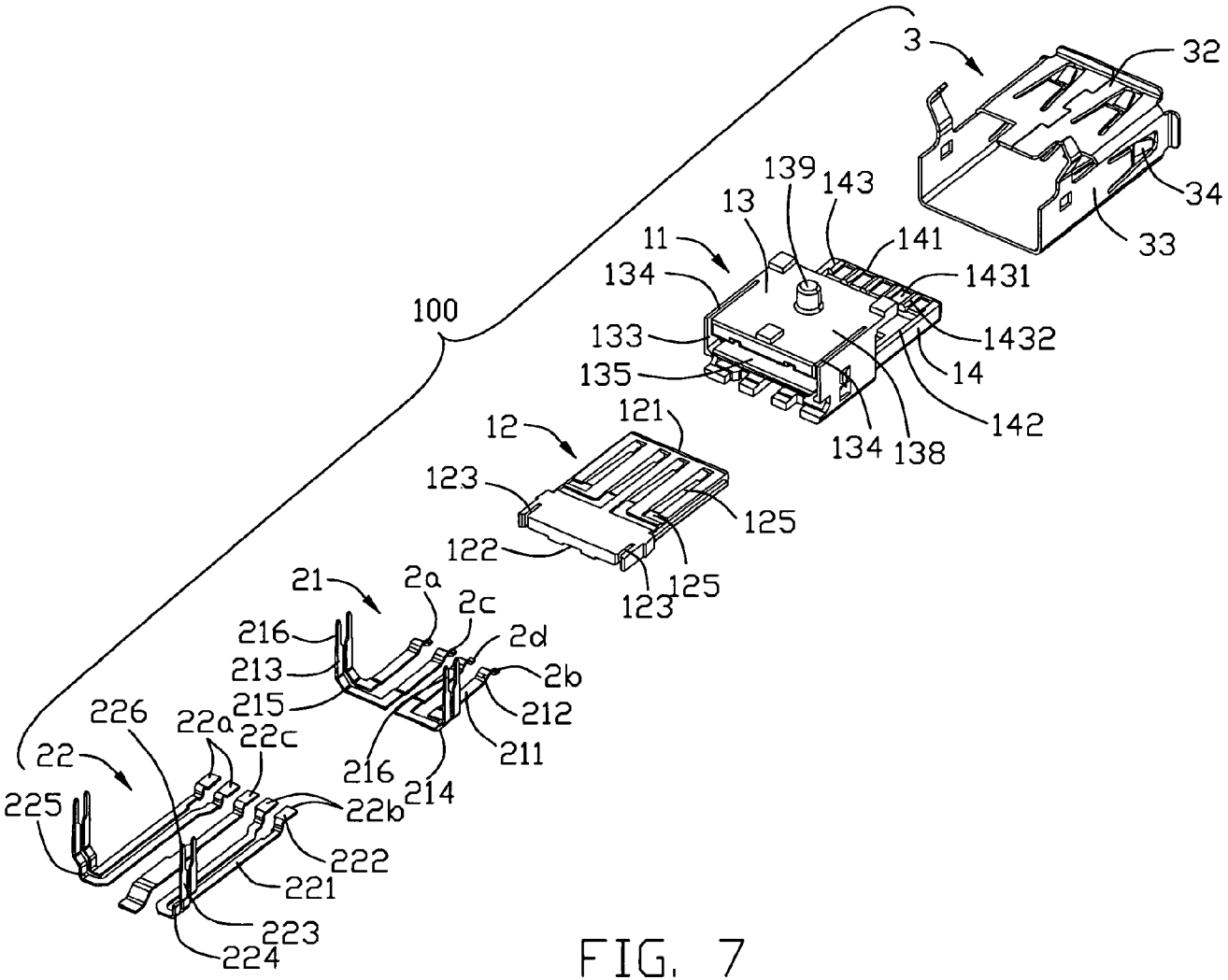
FIG. 7 is another exploded perspective view of the electrical connector shown in FIG. 2.
Figure 8:
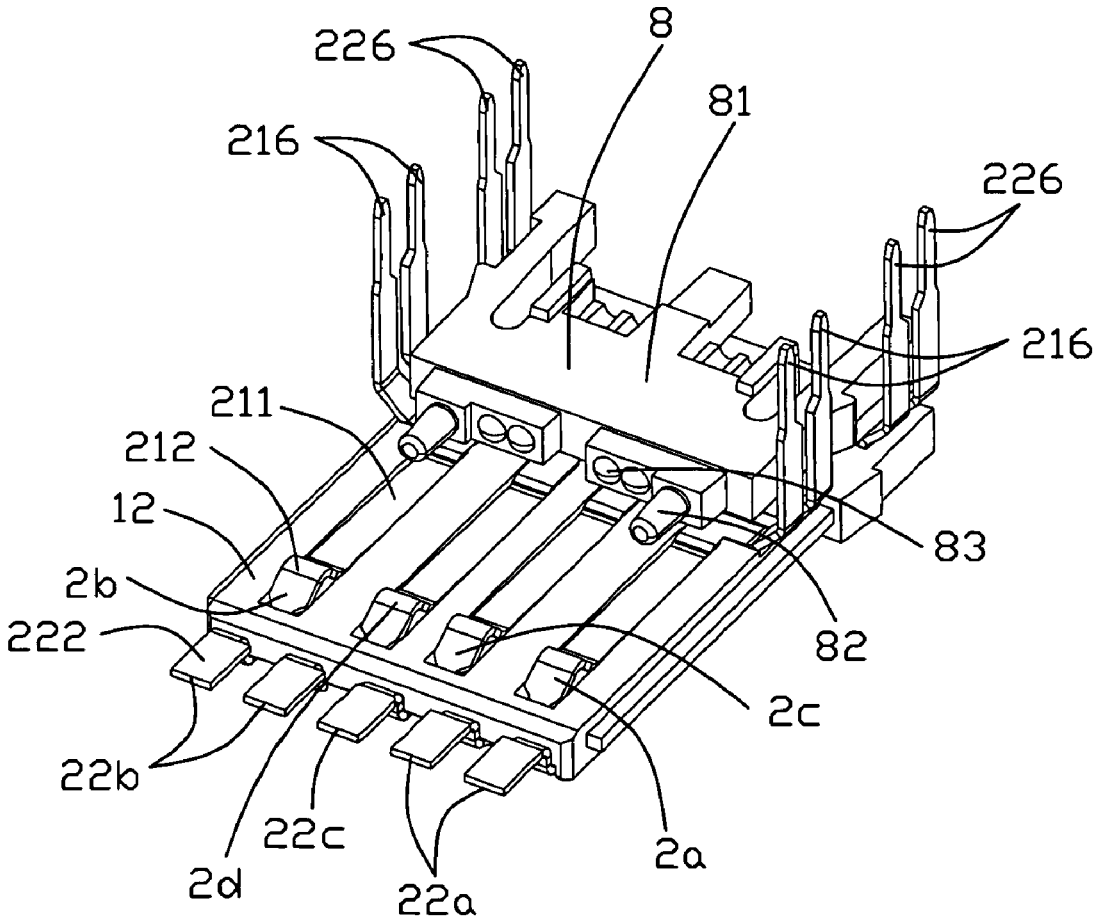
FIG. 8 is a perspective view of a contact module mating with the fiber optical lens module.

Referring to FIGS. 6 and 7, the first insulative housing 11 includes a base portion 13 and a tongue plate 14 extending forwardly from a front face 131 of the base portion 13. The tongue plate 14 extends along a longitudinal direction A-A as shown in FIG. 7. The base portion 13 includes a bottom mounting wall 138 and a rear face 133 opposite to the front face 131. A mounting post 139 is provided extending downwardly from the mounting walls 138 for being received in a corresponding through hole (not shown) defined in the PCB so that the electrical connector 100 can be firmly mounted on the PCB. A pair of parallel first slits 134 are recessed from the rear face 133 along the longitudinal direction A-A for regulating the contacts 2. The first slits 134 are located at opposite lateral sides of the first insulative housing 11. Besides, a through hole 135 is provided extending through the rear face 133 along the longitudinal direction A-A under a condition that the through hole 135 is adapted for receiving a fiber optical lens module 8 (shown in FIGS. 2, 5&8) in order to enhance high speed signal transmission of the electrical connector 100. The fiber optical lens module 8 has a main body 81, a pair of guiding posts 82 extending forwardly from the main body 81 and two pairs of optical components 83 between the guiding posts 82. In assembly, the fiber optical lens module 8 is optically connected to a precision block on the PCB (the PCB and the precision block not shown) for mating with another fiber optic of the complementary connector which is mateable with the electrical connector 100. The base 13 includes a rectangular shaped receiving cavity 136 throughout the front and the rear faces 131, 133 for receiving the second insulative housing 12. The receiving cavity 136 is located over the through hole 135 and is in communication with the first slits 134. The base 13 includes a top surface 137 and an opening 132 in communication with the receiving cavity 136. The opening 132 extends upwardly through the top surface 137 and extending backwardly through the rear face 133 for accommodating the corresponding contact.

The tongue plate 14 includes a free end 141 opposite to the base portion 13, a receiving opening 142 communicating with the receiving cavity 136, and a receiving base 143 located between the free end 141 and the receiving opening 142 along the longitudinal direction A-A. The receiving base 143 defines a plurality of parallel rectangular depressions 1431 communicating with the receiving opening 142, and then forms a plurality of projections 1432 separating the adjacent two depressions 1431 for ESD protection. Each depression 1431 extends along the longitudinal direction A-A as well.

The second insulative housing 12 includes opposite first and second ends 121, 122, and a plurality of second slits 123 recessed from the second end 122 for regulating the contacts 2. The second insulative housing 12 further defines a plurality of passageways 125 formed on opposite upper and lower sides thereof for mounting the contacts 2.

As shown in FIGS. 4-8, the contacts 2 include a plurality of first contacts 21 and a plurality of second contacts 22. The first contacts 21 include a power contact 2*a*, a ground contact 2*b*, a first signal contact 2*c* and a second signal contact 2*d* disposed side by side along the transverse direction B-B. The second contacts 22 include a first pair of differential contacts 22*a*, a second pair of differential contacts 22*b* and a grounding contact 22*c* located between the first and the second pairs of differential contacts 22*a*, 22*b*. Each first contact 21 includes an L-shaped first main portion 211, an elastic first contact portion 212 at one end of the first main portion 211, and a first bending portion 213 extending downwardly from the other end of the first main portion 211. The first main portion 211 has a certain width thereof and located in a horizontal plane. The other end of the first main portion 211 includes opposite lateral edges 214, 215 in the horizontal plane. The first bending portion 213 bends downwardly from one of the lateral edges 214, 215 and substantially perpendicular to the first main portion 211. The first bending portions 213 are regulated in the second slits 123 for preliminary position. The first bending portion 213 further includes a contractive first soldering portion 216 at a distal end thereof and extending downwardly to be soldered to the PCB.

Each second contact 22 includes a second main portion 221 and a stiff second contact portion 222 at one end of the second main portion 221. The second main portions 221 are located over the first main portions 211. The second contact portions 222 are parallel to the second main portions 221 while are located below the second main portions 221. Each differential contact 22*a*, 22*b* has a second bending portion 223 extending downwardly from the other end of the second main portion 221. The second main portions 221 are located in a horizontal plane. The other end of the second main portion 221 includes opposite lateral edges 224, 225 in the horizontal plane. The second bending portion 223 bends downwardly from one of the lateral edges 224, 225 and substantially perpendicular to the second main portion 221. The second bending portions 223 are regulated in the first slits 134 for preliminary position. The second bending portion 223 further includes a contractive second soldering portion 226 at a distal end thereof and extending downwardly to be soldered to the PCB.

Figure 9:
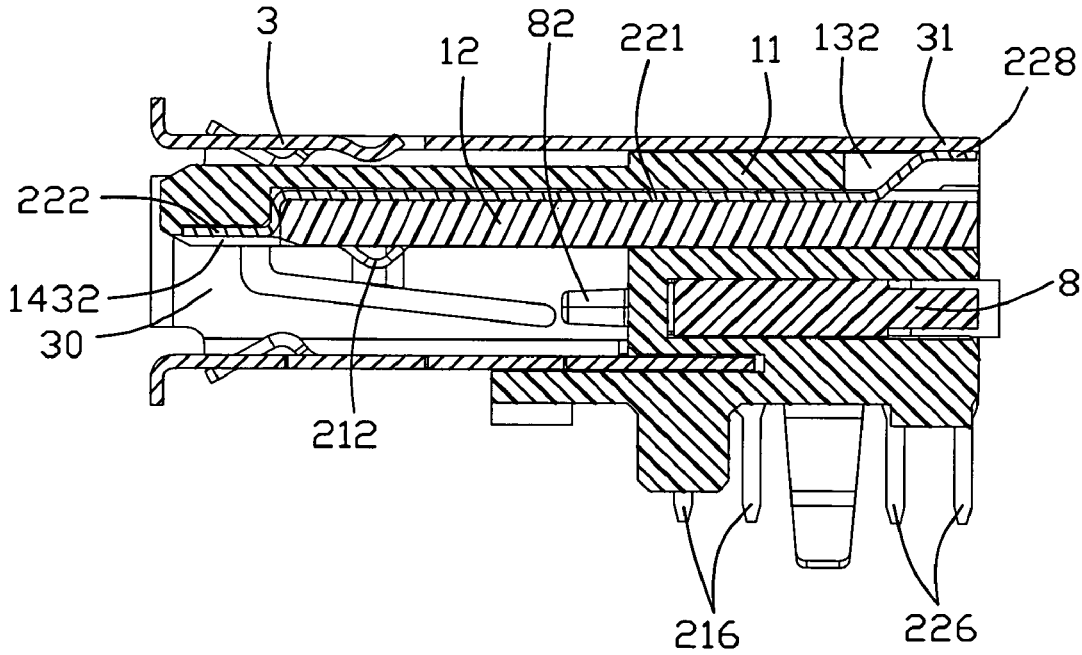
FIG. 9 is a cross-sectional view of the electrical connector and the fiber optical lens module taken along line 9-9 of FIG. 1.

Referring to FIGS. 6&9, the grounding contact 22*c* of the second contacts 22 is step shaped with its second main portion 221 located over its second contact portion 222. Besides, the grounding contact 22*c* further includes a grounding tab 228 extending backwadly and upwardly from the second main portion 221. The grounding tab 228 extends cantileveredly from the second main portion 221 and is located over the second main portion 221 to attach to the metal shield 3 for grounding purpose.

Figure 4:
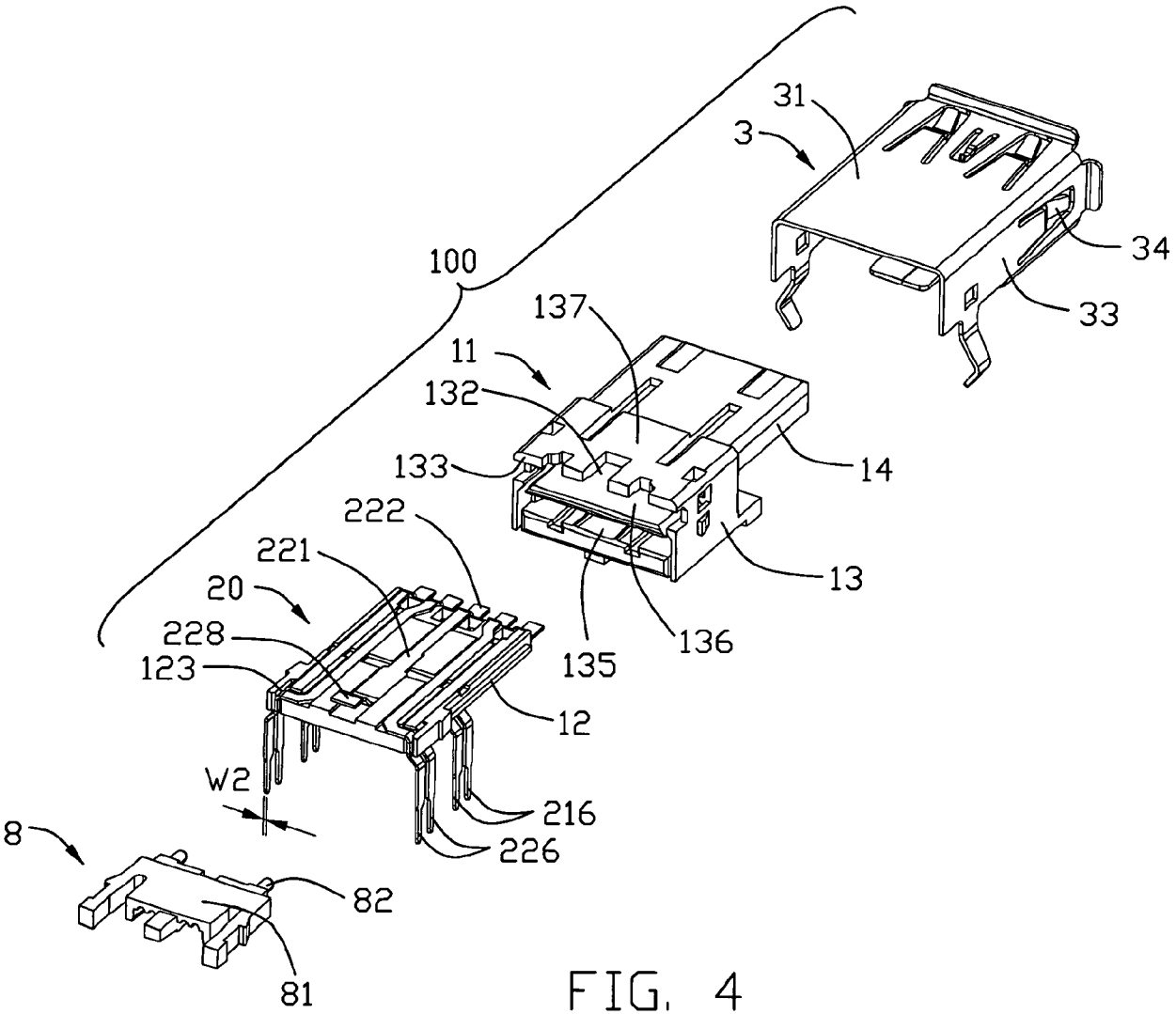
FIG. 4 is a part exploded perspective view of the electrical connector shown in FIG. 1 before insertion of the fiber optical lens module.

Referring to FIGS. 4-8, in assembly, the first and the second contacts 21, 22 are attached to the second insulative housing 12 from upper and lower sides thereof to form a contact module 20. The first and the second main portions 211, 221 are retained in the corresponding passageways 125 of the second insulative housing 12, and the second bending portions 223 extend through the second slits 123 for preliminary positioning. As shown in FIGS. 4&5, the second contact portions 222 further extend beyond the first end 121 of the second insulative housing 12. Besides, the grounding tab 228 extends cantileveredly over the second main portion 221. Then, the contact module 20 is jointly received in the receiving cavity 136 and the receiving opening 142 from a rear-to-front direction along the longitudinal direction A-A. The second contact portions 222 are received in the corresponding depressions 1431 of the tongue plate 14. At the mating end of the electrical connector 100, the first and the second contact portions 212, 222 are located at the same side of the housing member 1 while offset from each other along the longitudinal direction A-A. The first contact portion 212 deformably extends beyond the second insulative housing 12. The second bending portions 223 are received in the first slits 134 of the base portion 13. As best shown in FIG. 5, the first and the second soldering portions 216, 226 are arranged in only first and second parallel rows at opposite sides of the housing member 1, among which, in the first row, the first soldering portions 216 of the power contact 2*a* and the first signal contact 2*c* are aligned with the second soldering portions 226 of the first pair of differential contacts 22*a*. Similarly, in the second row, the first soldering portions 216 of the ground contact 2*b* and the second signal contact 2*d* are aligned with the second soldering portions 226 of the second pair of differential contacts 22*b*. The first and the second soldering portions 216, 226 are disposed at the mounting end of the electrical connector 100 for being soldered to the PCB.

As shown in FIGS. 4 and 5, each first or second bending portion 213, 223 has a first width W1 viewed from a left-to-right direction parallel to the transverse direction B-B, and a second width W2 viewed from the rear-to-front direction parallel to the longitudinal direction A-A, wherein the second width W2 is much narrower than the first width W1. As a result, the first and the second bending portions 213, 223 occupy a small space of a rear side of the first insulative housing 11 and left adequate space between the first and the second rows for insertion of the fiber optical lens module 8. Besides, at the mounting end of the electrical connector 100 as shown in FIG. 5, either in the first or in the second row, the most shortest space P1 between one of the first and one of the second soldering portions 216, 226 is much larger than any internal space P2 between the adjacent two first soldering portions 216 and any internal space P2 between the adjacent two second soldering portions 226. As a result, the performance of the differential to common mode conversion of the electrical connector 100 can be improved.

Referring to FIGS. 6 and 7, the metal shield 3 is in a tube shape, which defines a top wall 31, a bottom wall 32 opposite to the top wall 31 and a pair of sidewalls 33 connecting the top wall 31 and the bottom wall 32. The metal shield 3 is secured to the base portion 13 of the first insulative housing 11 to enclose the tongue plate 14 and the second insulative housing 12. The metal shield 3 encloses the housing member 1 to form a receiving space 30 to which the first and the second contact portions 212, 222 are exposed. The pair of guiding posts 82 of the fiber optical lens module 8 extend forwardly into the receiving space 30 for guiding insertion of the corresponding connector. The two pairs of optical components 83 are exposed to the receiving space 30 for mating with the corresponding connector. Each of the top and bottom walls 31, 32 and the pair of sidewalls 33 include at least one spring arm 34 projecting into the receiving space 30 for abutting against the corresponding connector for retaining and grounding purposes.

With the contact module 20 received in the receiving cavity 136 from the rear-to-front direction along the longitudinal direction A-A, the grounding tab 228 of the grounding contact 22*c* is mainly accommodated in the opening 132 to attach to an inner side of the top wall 31. However, attachment means may be in form of, but not limited to soldering or spring finger engagement. According to the present invention, the grounding contact 22*c* needn't be soldered to the PCB so that no soldering portion bending from the second main portion 221 is needed to extend through a space between the first and the second rows. As a result, a much integral space between the first and the second rows can be provided for receiving the fiber optical lens module 8.

The electrical connector 100 is compatible to the existing standard USB 2.0 plug which only has corresponding plug contacts for mating with the first contact portions 212. However, a USB 3.0 plug with essentially shape of the standard USB 2.0 plug while with additional contacts for mating with the second contacts 22 and/or the fiber optical lens module 8 can also be received in the electrical connector 100 for high signal transmission.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector for being mounted on a PCB, comprising:

a housing member;

a plurality of contacts attached to the housing member, the contacts comprising a plurality of first contacts having deformable first contact portions and a plurality of second contacts having stiff second contact portions under a condition that the first and the second contact portions are located at a same side of the housing member, the first and the second contact portions being respectively arranged side by side along parallel transverse directions, the first and the second contact portions offsetting from each other along a longitudinal direction perpendicular to the transverse directions, the second contacts comprising a first pair of differential contacts, a second pair of differential contacts and a grounding contact disposed therebetween, the first contacts and the first and the second pairs of differential contacts are used for being soldered to the PCB while the grounding contact needn't be soldered to the PCB; and a metal shell enclosing the housing member for being mounted on the PCB; wherein the grounding contact comprises a grounding tab opposite to the corresponding second contact portion to attach to the metal shell for grounding purpose.

2. The electrical connector as claimed in claim 1, wherein the housing member defines an opening through a top surface thereof under a condition that the grounding tab is mainly accommodated in the opening to deformably abut against the top wall of the metal shell.

3. The electrical connector as claimed in claim 1, wherein the second contact portions are positioned at the front of the first contact portions along the longitudinal direction.

4. The electrical connector as claimed in claim 1, wherein the first and the second contacts respectively comprise a plurality of first and second soldering portions for being soldered to the PCB, the first and the second soldering portions being only arranged in parallel first and second rows viewed from a rear-to-front direction along the longitudinal direction under a condition that the first and the second parallel rows are located at opposite sides of the housing member.

5. The electrical connector as claimed in claim 4, wherein the first contacts comprise first main portions extending from the first contact portions and first bending portions bending from lateral edges of the first main portions, the first main portions being mainly located at a same horizontal plane while the first bending portions being located at different vertical planes, the first soldering portions being formed at distal ends of the first bending portions; similarly, the second contacts comprising second main portions over the first main portions and second bending portions bending from lateral edges of the second main portions, the second main portions being mainly located at a same horizontal plane while the second bending portions being located at different vertical planes, the second soldering portions being formed at distal ends of the second bending portions.

6. The electrical connector as claimed in claim 5, wherein each of the first and the second bending portions comprises a first width viewed from a left-to-right direction along the transverse direction, and a second width viewed from a rear-to-front direction along the longitudinal direction in condition that the second width is narrower than the first width.

7. The electrical connector as claimed in claim 4, wherein the first contacts comprise a power contact, a ground contact, a first signal contact and a second signal contact under a condition that the first soldering portions of the power contact and the first signal contact are align with the second tail portions of the first pair of differential contacts in the first row, and the first tail portions of the second signal contact and the ground contact are align with the second tail portions of the second pair of differential contacts in the second row.

8. The electrical connector as claimed in claim 7, wherein, either in the first row or in the second row, the most shortest space between one of the first and one of the second soldering portions is much larger than an internal space between the adjacent two first soldering portions, and an internal space between the adjacent two second soldering portions.

9. The electrical connector as claimed in claim 1, wherein the housing member comprises a first insulative housing and a second insulative housing received in the first insulative housing, the first and the second contacts being assembled to the second insulative housing with the second contact portions extending beyond the second insulative housing in order to form a contact module, and wherein the contact module is inserted into the first insulative housing with the second contact portions fixed to the first insulative housing.

10. The electrical connector as claimed in claim 9, wherein the first insulative housing comprises a base portion and a tongue plate extending forwardly from the base portion, the tongue plate defining a receiving opening to receive the second insulative housing and a plurality of separate rectangular slots communicating with the receiving opening to receive the second contact portions.

11. An electrical connector for being mounted on a PCB, comprising:

a housing member;

a plurality of contacts attached to the housing member, the contacts comprising a plurality of first contacts having deformable first contact portions and first soldering portions, and a plurality of second contacts having stiff second contact portions and second soldering portions, the first and the second contact portions being located at a same side of the housing member, the first and the second contact portions being respectively arranged side by side along parallel transverse directions, the second contacts comprising a first pair of differential contacts, a second pair of differential contacts and a grounding contact disposed therebetween, the first and the second soldering portions being arranged in parallel two rows at opposite sides of the housing member when viewed along a longitudinal direction perpendicular to the transverse directions, wherein the first soldering portions and the second soldering portions of the first and the second pairs of differential contacts are used for being soldered to the PCB while the grounding contact needn't be soldered to the PCB; and a metal shell fixed to the housing member and enclosing the first and the second contact portions; and wherein the grounding contact comprises a grounding tab opposite to the corresponding second contact portion to attach to the metal shell for grounding purpose.

12. The electrical connector as claimed in claim 11, wherein the housing member defines an opening through a top surface thereof under a condition that the grounding tab is cantileveredly accommodated in the opening to deformably abut against a top wall of the metal shell.

13. The electrical connector as claimed in claim 11, wherein the grounding contact is step shaped and comprises a main section fixed to the housing member, the main section being parallel to and being located over the corresponding second contact portion, and similarly, the grounding tab being substantially parallel to and being located over the main section.

14. The electrical connector as claimed in claim 11, wherein the first contacts comprise first main portions extending from the first contact portions and first bending portions bending from lateral edges of the first main portions, the first main portions being mainly located at a same horizontal plane while the first bending portions being located at different vertical planes, the first soldering portions being formed at distal ends of the first bending portions; similarly, the first and the second differential contacts comprising second main portions over the first main portions and second bending portions bending from lateral edges of the second main portions, the second main portions being mainly located at a same horizontal plane while the second bending portions being located at different vertical planes, the second soldering portions being formed at distal ends of the second bending portions.

15. The electrical connector as claimed in claim 11, wherein the first contacts comprise a power contact, a ground contact, a first signal contact and a second signal contact under a condition that the first soldering portions of the power contact and the first signal contact are align with the second tail portions of the first pair of differential contacts in one row, and the first tail portions of the second signal contact and the ground contact are align with the second tail portions of the second pair of differential contacts in the other row.

16. The electrical connector as claimed in claim 11, wherein, in each row, the most shortest space between one of the first and one of the second soldering portions is much larger than an internal space between the adjacent two first soldering portions, and an internal space between the adjacent two second soldering portions.

17. The electrical connector as claimed in claim 11, wherein the housing member comprises a first insulative housing and a second insulative housing received in the first insulative housing, the first and the second contacts being assembled to the second insulative housing with the second contact portions extending beyond the second insulative housing in order to form a contact module, and wherein the contact module is inserted into the first insulative housing with the second contact portions fixed to the first insulative housing; wherein the first insulative housing comprises a base portion and a tongue plate extending forwardly from the base portion, the tongue plate defining a receiving opening to receive the second insulative housing and a plurality of separate rectangular slots communicating with the receiving opening to receive the second contact portions.

18. An electrical connector comprising:

a first insulative housing defining opposite first and second faces in a vertical direction and opposite lateral sides in a transverse direction perpendicular to said vertical direction;

a first set of contacts having deflectable first contacting sections exposed upon the first face and dispersed in said transverse direction, and downwardly extending first board mounting sections;

a second set of contacts having stiff second contacting section exposed around the first face and dispersed in said transverse direction and being offset from the deflectable first contacting sections of the first set of contacts in a front-to-back direction perpendicular to both said vertical direction and said transverse direction, and downwardly extending second board mounting sections;

a fiber optical lens modules disposed intimately beside the first face in said vertical direction;

both said first board mounting sections and said second board mounting sections extending from said two lateral sides so as to leave a space adjacent said first face in said vertical direction to allow said fiber optical lens module to be forwardly assembled to be intimately located beside the first face in said vertical direction.

19. The electrical connector as claimed in claim 18, further including a second insulative housing enclosing said first insulative housing.

20. The electrical connector as claimed in claim 19, further including a grounding contact similar to said second set of contacts except without the vertically extending board mounting section but with a grounding tab engaging a metallic shell which encloses the second insulative housing.

* * * * *